United States Patent [19]

Williams et al.

[11] 4,246,842

[45] Jan. 27, 1981

[54] PRINTING ROLLER

[75] Inventors: Leland E. Williams, Centerville, Ohio; James O. Griffith, Three Rivers, Mich.

[73] Assignee: Dayco Corporation, Dayton, Ohio

[21] Appl. No.: 63,877

[22] Filed: Aug. 3, 1979

Related U.S. Application Data

[63] Continuation of Ser. No. 881,329, Feb. 27, 1978, abandoned, which is a continuation-in-part of Ser. No. 752,487, Dec. 20, 1976, abandoned.

[51] Int. Cl.[3] ..... B41F 21/36

[52] U.S. Cl. ..... 101/367; 101/348; 101/331

[58] Field of Search ..... 101/367, 364, 365, 335, 101/327, 348, 331; 400/470

[56] References Cited

U.S. PATENT DOCUMENTS

| | | | |
|---|---|---|---|
| 2,007,588 | 7/1935 | Wescott | 101/367 |
| 2,763,208 | 9/1956 | Rockoff et al. | 101/327 |
| 2,777,824 | 1/1957 | Leeds | 101/327 |
| 3,139,826 | 7/1964 | Rainwater | 101/348 |
| 3,253,542 | 5/1966 | McDonough | 101/367 |
| 3,738,269 | 6/1973 | Wagner | 101/331 |
| 3,797,388 | 3/1974 | Kaminstein | 101/367 |
| 3,812,782 | 5/1974 | Funahashi | 101/367 |
| 3,928,521 | 12/1975 | Haren et al. | 101/367 |
| 3,971,315 | 7/1976 | Hansen | 101/367 |
| 4,025,685 | 5/1977 | Haren et al. | 101/327 |

OTHER PUBLICATIONS

Vock, "Porous Roll Development System," Xerox Disclosure Journal, vol. 1, No. 4, p. 27, 4/76.

Cross, "Ribbonless Impact Printer," IBM Technical Disclosure Bulletin, vol. 14, No. 3, p. 898, 8/71.

*Primary Examiner*—William Pieprz

*Attorney, Agent, or Firm*—Charles E. Bricker; Reuben Wolk'

[57] ABSTRACT

A printing roller is provided wherein such roller comprises an inner layer and a concentric ink applying tubular outer layer made of a microporous rubber material having cavities interconnected by passages defining a first ink flow control means. The inner layer is made of a sintered mass of material having a reticulated open pore structure which is harder than the outer layer, and acts as a second ink flow control means to provide uniform inking. The layers cooperate to define a substantially rigid roller having a soft ink applying layer.

6 Claims, 5 Drawing Figures

PRINTING ROLLER

CROSS REFERENCE TO RELATED APPLICATION

This is a continuation of U.S. Patent Application Ser. No. 881,329, filed Feb. 27, 1978 (now abandoned), which in turn is a continuation-in-part of U.S. Patent Application Ser. No. 752,487, filed Dec. 20, 1976 (now abandoned).

BACKGROUND OF THE INVENTION

Self-contained ink applying or printing rollers are known in the art and U.S. Pat. Nos. 3,738,269 and 3,928,521 are examples of such rollers. However, because of the highly competitive nature of the industry producing printing rollers there have been numerous efforts to produce an improved self-contained printing roller at minimum cost particularly for applications where it is desirable to have a somewhat rigid roller which has a soft printing surface to provide uniform inking.

SUMMARY

It is a feature of this invention to provide a self-contained printing roller which is of simple construction and economical to produce.

Another feature of this invention is to provide a roller of the character mentioned having a soft printing or ink applying layer.

Another feature of this invention is to provide a printing roller of the character mentioned which has an ink applying layer which provides uniform inking.

Another feature of this invention is to provide a printing roller of the character mentioned in which the uniform inking is made possible by a plurality of improved successive ink flow control means.

Another feature of this invention is to provide a printing roller comprised of a soft tubular outer ink-applying layer made of a single layer of homogeneous microporous rubber material having cavities interconnected by passages, the cavities and passages defining voids which are uniformly disposed throughout and serve as an outer ink flow control means; and a harder inner layer adjacent the outer layer and made of a sintered mass of material having a reticulated open pore structure which defines a second ink flow control means wherein the ink flow control means provides a successive dual control for ink contained in the roller to provide uniform inking.

Accordingly, it is an object of this invention to provide an improved printing roller having one or more of the novel features set forth above or hereinafter shown or described.

Other details, features, objects, uses, and advantages of this invention will become apparent from the embodiments thereof presented in the following specification, claims, and drawing.

BRIEF DESCRIPTION OF THE DRAWING

The accompanying drawing shows present preferred embodiments of this invention, in which.

DESCRIPTION OF ILLUSTRATED EMBODIMENTS

Figure 1:
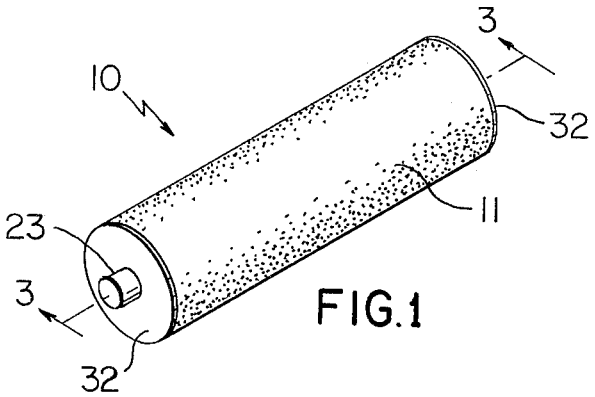
FIG. 1 is a perspective view illustrating one exemplary embodiment of the printing roller of this invention having a tubular outer layer made of a microporous rubber material and an inner layer with improved ink flow control means.
Figure 2:
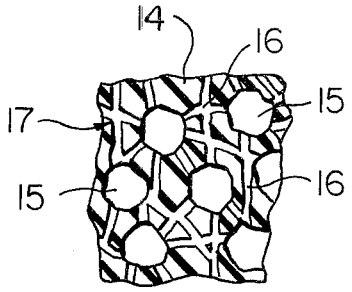
FIG. 2 is a greatly enlarged fragmentary cross-sectional view of the outer layer of the roller of FIG. 1.
Figure 3:
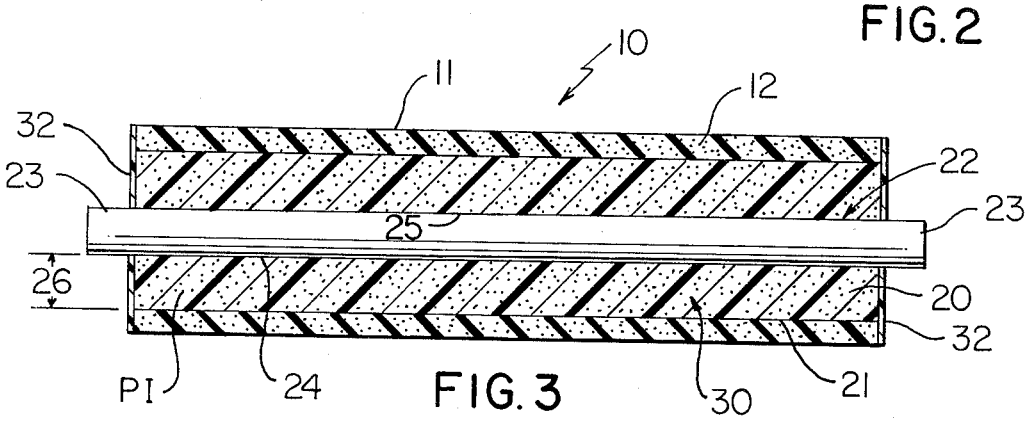
FIG. 3 is a primarily cross-sectional view taken essentially on the line 3—3 of FIG. 1 and illustrating an elongated central shaft comprising such roller in elevation.

Reference is now made to FIG. 1 of the drawings which illustrates one exemplary embodiment of a printing roller of this invention which is designated generally by the reference numeral 10 and such printing roller is a substantially rigid roller, i.e., maintains its straight configuration when supported on its support shaft during printing action, yet has a comparatively soft printing or ink applying outer layer 12 which provides uniform inking, having an outer surface designated by the reference numeral 11. The printing roller 10 is particularly adapted to be used in applications, such as, so-called marking or character printing to provide a direct reading impression on an original label or document and such roller is particularly adapted to provide substantially uniform inking and acceptable print quality over a substantial service life in excess of several tens of thousands of printing impressions. As seen in FIG. 2, the tubular outer layer 12 is made of a microporous rubber material in the form of a matrix material 14 having cavities 15 disposed therein and such cavities are interconnected by passages 16 defining outer ink flow control means designated by the reference numeral 17. The manner of making the microporous rubber material comprising the rubber layer 12 will be presented in more detail subsequently.

The printing roller 10 also has a tubular inner layer 20 which is disposed adjacent the outer layer 12 and in this example of the invention adjoins such outer layer 12 on an interface 21 which is in the form of a right circular cylindrical interface. The roller 10 has support means 22 and in this example of the invention such support means is in the form of a right circular cylindrical shaft 22 which may be of either solid or tubular cross section. The shaft has opposite end portions 23 extending outwardly from the tubular layers 12 and 20 and has a right circular cylindrical outside surface 24. The tubular inner layer 20 has an inside surface 25 which adjoins the surface 24 and is supported thereby whereby the layer 20 has a substantial radial thickness 26 which extends between surface 24 and the interface 21.

The inner layer 20 is made of a sintered mass of material having a reticulated open pore structure, to be subsequently described, and such reticulated open pore structure indicated at 30 and defines an inner ink flow control means also designated by the reference numeral 30. The ink flow control means for the roller 20 is comprised of the inner ink flow control means 30 and the outer ink flow control means 17. The ink flow control means 30 and 17 provide a plurality of successive controls and in this example successive dual controls for ink contained in the roller to thereby assure that the ink applying surface 11 provides uniform inking. It will be appreciated that the printing ink contained in the roller 10 is the printing ink, designated PI, contained in the reticulated open pore structure defining the tubular inner layer 20 as well as ink contained in the cavities 15 and passages 16 of the microporous rubber material of the outer layer 12.

The outer end portions 23 of the support shaft 22 are suitably rotatably supported on associated supports in accordance with techniques which are known in the art. Further, the shaft 22 may be a tubular shaft with solid end portions.

The roller 10 is provided with fluid impervious seal means 32 at the outer end surfaces of the layers 12 and 20. The seal means 32 may be in the form of a fluid impervious adhesive layer or in the form of annular fluid impervious disc suitably bonded in position to prevent seepage of ink from the opposed ends of the roller 10.

The tubular outer layer 12 preferably is microporous rubber material and although any suitable material may be used for this purpose one example of a material which is preferably employed is a salt leached microporous rubber made in accordance with the teaching of U.S. Pat. No. 3,928,521. As mentioned in this patent, sized particles of a suitable salt in the form of hydrated magnesium sulfate are provided by any known means or process and uniformly mixed in an elastomeric or rubber matrix material to define a loaded rubber matrix material designated by the reference numeral 14 in FIG. 2. Accordingly, the loaded rubber matrix material 14 is a rubber matrix material loaded in a uniform manner with particles of magnesium sulfate. The loaded material is then cured and leached and during the curing thereof, there is a substantially simultaneous liberation of water of crystallization from the hydrated magnesium sulfate which provides a blowing effect and results in the formation of interconnecting passages 16 between the particles of magnesium sulfate. Once the particles of magnesium sulfate are leached out the cavities 15 are defined therein whereby the microporous rubber matrix material 14 is defined having cavities 15 interconnected by passages 16, and since the sized particles were uniformly disposed, the resulting cavities and passages define voids which are likewise uniformly disposed throughout the entire outer layer. The cured and leached rubber material with the interconnected cavities defined therein is then suitably rinsed to remove any residual magnesium sulfate and any residual water is then removed preferably by air drying. Following the air drying of the material, the tubular outer layer is formed utilizing any suitable known technique and installed in position as part of the roller 10.

Thus, it is seen that the tubular outer layer 12 is preferably a single homogeneous microporous rubber layer having uniformly disposed voids defined by the cavities 15 interconnected by passages 16 thereof. The voids thus define the outer flow control means 17 of the roller 10. The amount of voids present in the outer layer 12 defined by cavities 15 and passages 16 may be any suitable amount and preferably the voids represent 30 to 70 percent of the total volume of the layer 12. Inasmuch as a soft outer layer is desired for ink application, a preferred hardness is in the range of 20 to 30 on the Shore D scale.

As previously mentioned, the tubular layer 20 is made of a sintered mass of material having a reticulated open pore structure and the total void space defined by this open pore structure is within the range of 25 to 75 percent of the total volume of the tubular layer 20. Further, it will be appreciated that such open pore structure may be defined by a sintered mass of material which may be either plastic or metallic material, such sintered mass is preferably defined by particles having sizes ranging between 20 and 500 microns. The open pore structure of layer 20 defines the inner ink flow control means 30 previously mentioned. The sintered mass of material may be made using any technique known in the art and preferably such sintered mass is in the form of a sintered mass of various synthetic plastic materials such as disclosed in U.S. Pat. Nos. 2,695,425 and 3,336,244. With respect to these materials, the subject matter of these patents is incorporated in this disclosure by reference thereto. It is important to provide rigidity to the entire roller despite the softness of the outer layer. The layer 20, therefore, should preferably have a hardness of about 65 to 75 on the Shore D scale, which is harder than the outer layer 12.

Figure 4:
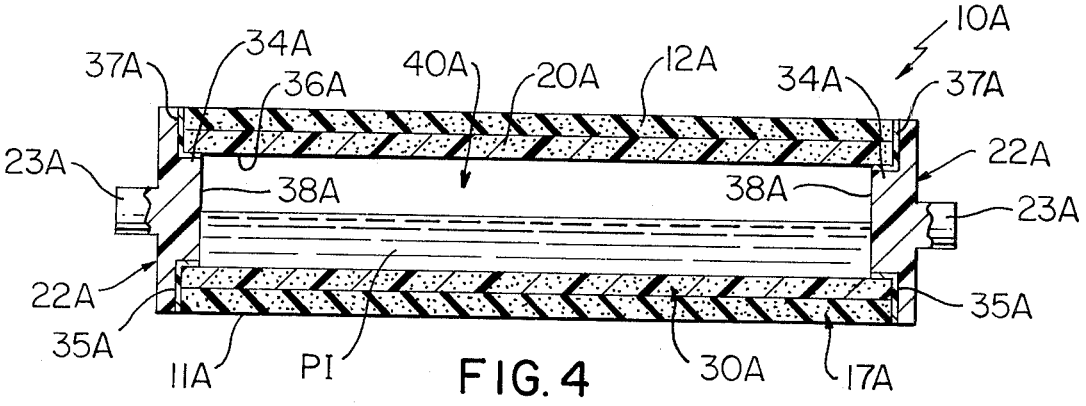
FIG. 4 is a view similar to FIG. 3 illustrating another exemplary embodiment of the printing roller of this invention.
Figure 5:
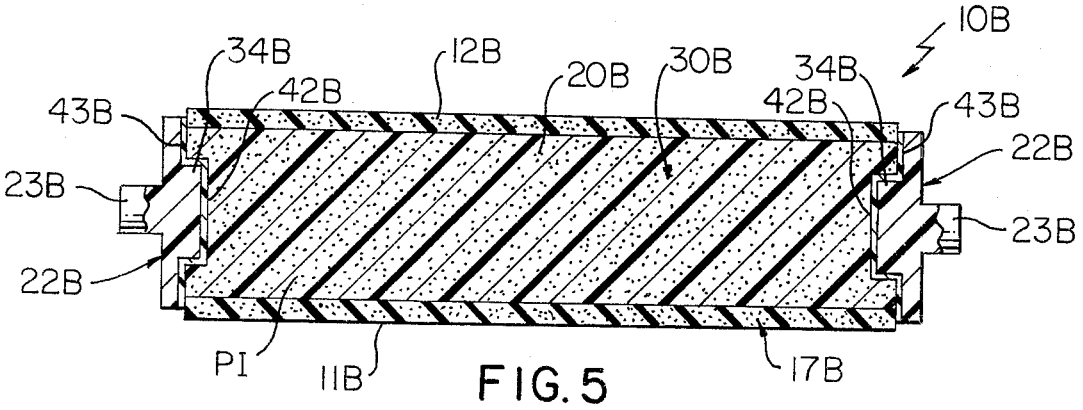
FIG. 5 is a view similar to FIG. 3 illustrating another exemplary embodiment of the printing roller of this invention.

Other exemplary embodiments of this invention are illustrated in FIGS. 4 and 5 of the drawing. The printing rollers illustrated in FIGS. 4 and 5 are very similar to the printing roller 10; therefore, such printing rollers will be designated by the reference numerals 10A and 10B respectively. Similar components will be designated by similar reference numerals followed by "A" or "B" respectively.

The main difference between the printing roller 10A and the printing roller 10 is that the printing roller 10A has support means 22A defining opposite end portions thereof and such support means are in the form of plate-like or hub-like members 22A each having an end portion 23A which is adapted to be suitably rotatably supported on an associated apparatus with which the roller 10A is used. Each support means 22A has an inward cylindrical projection 34A defining an annular stepped surface 35A and projection 34A is adapted to be received within the inside surface 36A of the inner layer 20A with a substantially annular seal 37A therebetween whereby the right circular cylindrical projection 34A supports and transmits the entire load transmitted radially inwardly by layers 12A and 20A.

The inside surface 36A of the tubular inner layer 20A and inside surfaces 38A of projections 34A cooperate to define a substantially cylindrical reservoir designated generally by the reference numeral 40A for the roller 10A. The reservoir 40A is particularly adapted to contain printing ink designated by the letters PI.

Although the printing roller 10A has a central reservoir 40A therein, it will be appreciated that the inner layer still provides inner ink flow control means 30A and the outer tubular layer provides outer ink flow control means 17A whereby the ink flow control means 30A and 17A provide successive dual control for the printing ink PI contained in the roller to thereby assure that the ink applying surface 11A provides uniform inking.

The volume of the sintered mass defining the inner layer 20A of roller 10A also has 25 to 75 percent voids therein; however, such sintered mass is preferably made in accordance with techniques known in the art using metallic or plastic particles ranging in size between 15 and 100 microns. The hardness of outer layer 12A is the same as layer 12, and the hardness of inner layer 20A is the same as layer 20.

The printing roller 10B in FIG. 5 instead of having an inner tubular layer, as such, has an inner mass which is in the form of a cylindrical mass 20B of solid cross section throughout having the same hardness as layer 20. Opposed support means 22B having supporting portions 23B are provided in a similar manner as described in connection with the support means and outer support shaft portions 22A and 23A respectively of roller 10A. Each support means 22B has a cylindrical projection 34B projecting inwardly within an associated substantially right circular cylindrical recess 42B provided in the solid mass 20B and seal means, in the form of a hat-shaped layer 42B, may be provided between mass 20B, outer layer 12B, and support means 22B to assure that there is no seepage of printing ink PI from opposed ends of the roller 10B. The printing ink in the roller 10B is contained in the voids of the mass 20B and the voids of layer 12B.

It will be appreciated that in the roller 10B the printing ink PI is contained in the reticulated open pore structure of the mass 20B which defines the voids thereof and such voids comprise between 25 and 75 percent of the mass 20B. Further, in the microporous rubber layer 12B, which has the same hardness as the layer 12, between 30 and 70 percent voids are present also containing the printing ink PI. The roller 10B has inner ink flow control means 30B in the inner member 20B and outer ink flow control means 17B in the tubular outer layer which define successive dual ink flow control means in a similar manner as previously described for the rollers 10 and 10A; and, such ink flow control means assure provision of printing ink in a uniform manner on the ink-applying surface 11B.

The support means 22 of the roller 10, support means 22A of the roller 10A, and the support means 22B of the roller 10B may be made of any suitable material known in the art including metallic materials or plastic materials (shown by cross hatching in the drawings for the support means 22A and 22B). Further, it will be appreciated that these components may be made of any other suitable material or combination of materials commonly used in the art to provide support means for supporting a printing roller of this type.

The printing roller of this invention may be filled with printing ink PI using any technique known in the art including reverse flow of ink through the tubular outer layer and through or into the inner layer portion or inner mass, as the case may be .

It will be readily apparent from the construction thereof that the roller of this invention has optimum structural rigidity yet has a comparatively soft outer layer which provides uniform inking over a substantial service life.

While present exemplary embodiments of this invention, and methods of practicing the same, have been illustrated and described, it will be recognized that this invention may be otherwise variously embodied and practiced within the scope of the following claims.

What is claimed is:

1. A printing roller consisting of annular inner and outer layers each having inner and outer surfaces, and a central reservoir, said outer layer consisting of a soft single piece tubular homogeneous ink-applying microporous rubber material having cavities interconnected by passages defining a first ink flow control means and having a hardness of about 20 to 30 on the Shore D scale, said cavities and passages defining uniformly disposed voids comprising between 30 and 70 percent of the total volume of said layer; said inner layer having its outer surface contiguous with the inner surface of said outer layer and consisting of a harder sintered mass of material having a reticulated open pore structure with voids comprising between 25 and 75 percent of the total volume of said layer and defining a second ink flow control means and having a hardness of about 65 to 75 on the Shore D scale; said reservoir defined by the inner surface of said inner layer adapted to contain printing ink for said roller; said first and second ink control means providing a successive dual control for ink contained in said roller to provide uniform inking.

2. A printing roller as set forth in claim 1 in which the voids of said outer layer are defined by sized particles of hydrated magnesium sulfate uniformly disposed throughout said layer and leached therefrom after curing.

3. A printing roller as set forth in claim 1 in which said inner layer is made of a sintered mass of metallic material.

4. A printing roller as set forth in claim 1 in which said inner layer is made of a sintered mass of synthetic plastic material.

5. A printing roller as set forth in claim 4 in which said sintered mass of synthetic plastic material is defined by particles having sizes ranging between 20 and 500 microns.

6. A printing roller as set forth in claim 1 including support means comprising a pair of hub-like portions defining opposite end portions thereof and rotatably supporting said roller and further comprising means sealing opposite end edges of said layers, said sealing means cooperating with the inner surface of said inner layer to define said reservoir, said reservoir being free of separate vents.

* * * * *